United States Patent [19]

Gabriel et al.

[11] Patent Number: 4,945,828

[45] Date of Patent: Aug. 7, 1990

[54] PULLEY FOR DRIVING A HIGH PERFORMANCE PRINTER

[75] Inventors: Charles F. Gabriel, Binghamton; Randy J. Kisacky, Johnson City; John Mako; Lawrence A. Stone, both of Endicott, all of N.Y.

[73] Assignee: International Business Machines Corporation, Armonk, N.Y.

[21] Appl. No.: 295,987

[22] Filed: Jan. 12, 1987

[51] Int. Cl.[5] ..... B41J 1/20

[52] U.S. Cl. ..... 101/93.14; 101/111; 400/146

[58] Field of Search ..... 101/93.13, 93.14, 111; 474/69, 70, 23; 464/70, 85, 112, 160, 161; 310/75 A, 75 D, 74, 118; 74/37; 400/144.3, 146

[56] References Cited

U.S. PATENT DOCUMENTS

| | | | |
|---|---|---|---|
| 3,384,216 | 5/1968 | Thayer | 400/144.3 |
| 3,819,966 | 6/1974 | Noguchi | 310/74 |
| 4,161,373 | 7/1979 | Chvatlinsky | 400/144.2 |
| 4,324,498 | 4/1982 | Steinhardt | 400/144.2 |
| 4,803,855 | 2/1989 | Kennedy | 764/160 |

*Primary Examiner*—Edgar S. Burr
*Assistant Examiner*—Joseph R. Keating
*Attorney, Agent, or Firm*—Douglas M. Clarkson

[57] ABSTRACT

A pulley for connecting a driven device, that is sensitive to speed variations, to be driven by an a.c. motor that is susceptible to speed variations, caused by power line disturbances. The pulley has a peripheral drive surface for a belt drive and two side surfaces through which an opening is formed to receive a drive shaft that is turned by the a.c. motor. One of the sides of the pulley has a slot formed therein with surfaces on each side of the slot. A resilient material of a preselected Durometer value is positioned within the slot and contiguous with at least one of the surfaces in the slot, against which an element projecting from the drive shaft acts to turn the pulley. During a momentary slowdown in the motor speed, the projecting element moves away from the resilient material and permits the momentum of the driven device to maintain its speed while the motor recovers its speed.

12 Claims, 3 Drawing Sheets

PULLEY FOR DRIVING A HIGH PERFORMANCE PRINTER

BACKGROUND OF THE INVENTION

1. Field of the invention

The present invention, generally, relates to drive systems for belt type printers in which respective type font are attached to and carried by a moving belt and, more particularly, to a new and improved drive pulley for interconnecting such a moving belt with an electric motor of the type that is responsive to power line disturbances.

An alternating current (a.c.) motor is used customarily as the principal driver in belt type printers for many reasons, but they do have a susceptibility to follow power line frequency sometimes too well, because by doing so, they fall victim to every power line disturbance. A synchronous a.c. motor will respond to these power line disturbances with an instantaneous change in the motor lag angle, and the motor speed will change to this new lag position. When this occurs, the change in the velocity of the print belt is so fast, the print control electronics is unable to respond and bad character printing occurs.

2. Description of the Prior Art

U.S. Pat. No. 1,550,779 to Carpenter discloses a shaft coupling that is adapted especially for use in the driving connection of a washing machine, where the drum is rotated in alternating directions. It is intended to overcome the considerable momentum that is developed when a direction of rotation is reversed suddenly, which can produce shock in the transmission mechanism.

Carpenter uses a drive pin in a clearance slot in the hub to permit "slack motion", and a split spring is used to provide damping in both directions of rotation. While this structure appears to be effective in controlling shock developed in a sudden reversal of a direction of rotation, it does not concern maintaining a constant rotation in a driven shaft, such as with a structural arrangement according to the invention.

U.S. Pat. No. 1,138,779 to Scott provides a coupling that permits adjusting the hub of a shaft that is locked in place by a set screw after the new adjustment is achieved. This arrangement is not effective in maintaining a driven shaft at its given speed of rotation, as with the present invention.

A De Voe Pat. No. 1,387,043 discloses a universal joint arrangement that uses a pin to hold a driven shaft to a drive shaft, but it makes no provision for damping or for maintaining the rotational speed of a driven shaft constant during intervals of drive shaft speed variation.

A Pat. No. 2,474,347 to Collins uses a resilient material to dampen engine vibration, but is different structurally from that of the present invention. The Collins flexible drive proposes to attach a driver shaft to a driven shaft through a flexible material held to the driver shaft by four pins and this assembly is attached to a driven shaft by a pin passing through the flexible material. While this structure may be effective to dampen vibrations, it cannot maintain the driven shaft at its rotational speed while the driver shaft speed varies.

U.S. patent to Baker et al. No. 2,800,777 discloses a universal joint arrangement for damping vibration between drive and driven shafts, but it will not permit the driven shaft to maintain its preset rotational speed while the driver shaft speed varies.

While the structural arrangements of the prior art at first appearance have similarities with the structure of the invention, they differ in material aspects, primarily in that they do not permit the driven shaft speed to be maintained constant while the drive shaft speed is varied. This function is essential for the satisfactory operation of a high performance belt type printer. Moreover, a structure such as that of the invention permits other advantages that are not available with the prior art structures.

OBJECTS AND SUMMARY OF THE INVENTION

A principal object of the present invention is to provide a new and improved pulley structure to permit a driven member to be maintained at a predetermined rotational speed while the drive element slows momentarily.

It is also an important object of the invention to provide a pulley structure that admits the drive element to follow power line frequency by momentarily slowing without affecting the rotational speed of the driven element adversely.

Another object of the invention is to provide a pulley constructed to permit a drive element to slow momentarily without transferring such a deviation in rotational speed to a driven element.

Still another object of the invention is to provide a new and improved pulley so constructed as to permit a substantially constant rotational speed of a driven element over several repeated deviations in the rotational speed of a drive element.

Briefly, a pulley that is constructed in accordance with the present invention includes a cylindrical member with an outer drive surface of a predetermined diameter, two opposite end faces, and a central hole to receive a driver shaft. Means affixed to the driver shaft bears against a resilient surface to transmit rotational motion at a substantially constant speed to the outer drive surface of the pulley while permitting to slow momentarily without affecting the speed of the outer drive surface.

The above and other objects, advantages and features of the present invention will become more readily apparent from the following detailed description of the presently preferred embodiment as illustrated in the accompanying drawings.

DETAILED DESCRIPTION OF THE INVENTION

Figure 2:
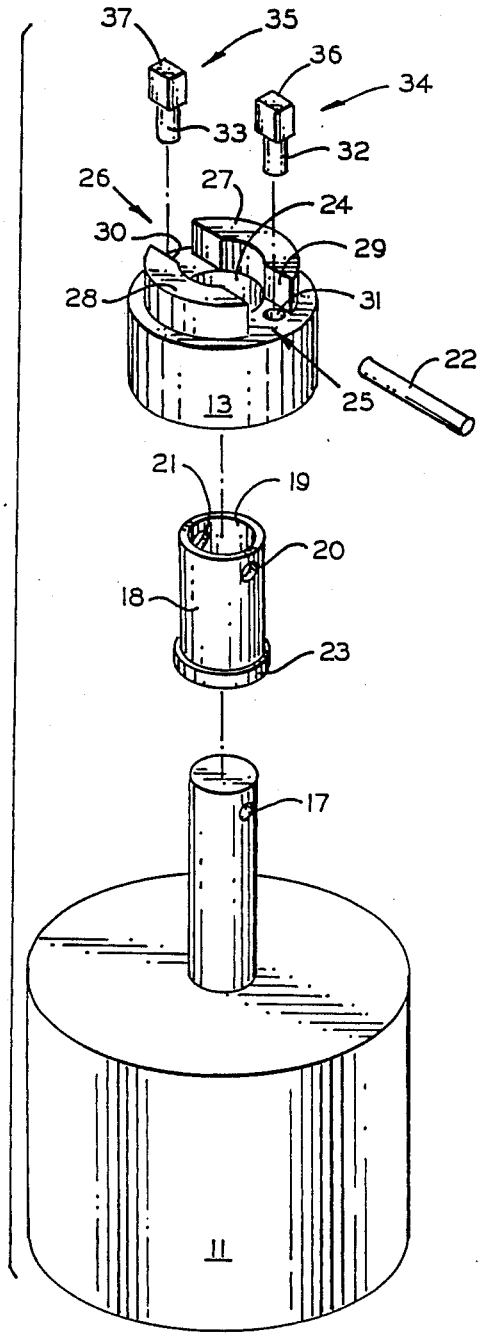
FIG. 2 is an exploded view of the drive system assembly of FIG. 1.

The same reference numerals are used in the various views of the drawings to identify the same or comparable component parts.

Figure 1:
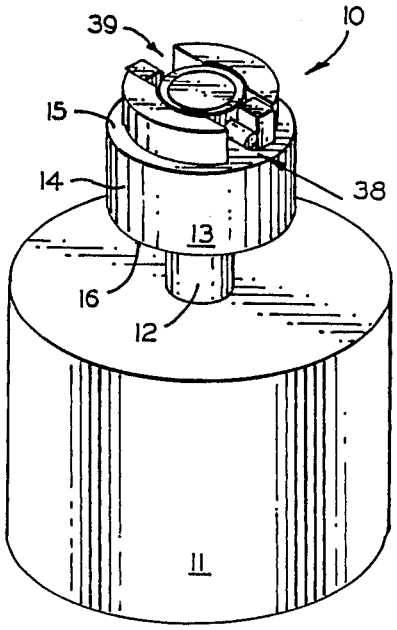
FIG. 1 is a perspective view of an assembled drive system that includes the pulley of the invention.

In FIG. 1, the numeral 10 identifies a drive assembly generally that includes a synchronous alternating current motor 11 having a rotatable drive shaft 12. It is a known characteristic of an alternating current (a.c.) motor drive system that, although the a.c. motor is synchronous with the power line frequency, it does not provide an absolutely "smooth" rotation to a driven shaft, such as 12.

Until fairly recently, it was thought that a synchronous a.c. motor was "smooth" rotatably. However, as technology advanced, much has been learned about previously accepted conclusions, such as synchronous a.c. motors. Now, it is known that the line frequency, of 50 Hz or 60 Hz, will have its "imprint" on the speed of a synchronous a.c. motor. This will be described in more detail hereinafter.

A pulley 13 is attached to the rotatable drive shaft 12 and has a pulley drive surface 14 with two side faces 15 and 16, only the side face 15 being visible. The structure in accordance with the present invention is formed on the side face 15 and will be described in detail in connection with FIG. 2.

In FIG. 2, the respective component parts of the drive assembly 10 are illustrated more clearly. The synchronous a.c. motor 11 with its drive shaft 12 is seen as having a hole 17 that passes all the way through the shaft 12.

A bushing 18 has a central, axially aligned opening 19 to fit in sliding relationship over the drive shaft 12 and has two aligned openings 20 and 21 to receive a drive pin 22 for attaching the bushing 18 to the drive shaft 12 tightly and, also, to project from the drive shaft to act against the pulley 13 rotatably, as will be explained.

Formed at the opposite end of the bushing 18 from the openings 20 and 21 is an enlarged shoulder 23. The bushing 18, in the presently preferred embodiment, is formed of sintered bronze material that is impregnated with a lubricant to ensure that the pulley 13 will be free to turn thereon, as will be described.

After the bushing 18 is installed over the drive shaft 12 with the openings 20 and 21 in alignment with the hole 17, the pulley 13 is installed over the bushing 18 against the shoulder 23 by an opening 24 receiving the bushing 18 and, then, the drive pin 22 is inserted through a space 25, through the opening 20, through the tight fitting hole 17, through the opening 21 and through a space 26. These spaces 25 and 26 will be described in more detail presently.

The pulley drive surface 14 is illustrated as being smooth, but it may have ridges, grooves, etc., to fit with a timing belt. Whether the pulley drive surface 14 is any particular configuration will, of course, depend upon the specific use to which the pulley of the invention is to be put. As the invention was developed, it is particularly useful with a belt type printer. As will be explained hereinafter, however, the invention is not to be limited to this use.

Formed integrally with the pulley 13 are two raised members 27 and 28 of sufficient size to transmit a torque for turning the pulley 13. However, for the purpose of this description, these raised members 27 and 28 form two surfaces 29 and 30 (only the surface 29 being clearly visible in FIG. 2).

There are two apertures in the side surface 15, only one being visible in FIG. 2, and that aperture is identified by the reference numeral 31. These apertures, such as 31, are located close to the respective surfaces 29 and 30 and are just deep enough to receive the respective ends 32 and 33 of two resilient inserts 34 and 35.

The resilient inserts 34 and 35 are formed of rubber in the presently preferred embodiment because it is an important aspect of the invention that the resilience of the inserts be suitable. It has been found that inserts with a Durometer value range of 75 to 85 Shore A is satisfactory. Each of the resilient inserts 34 and 35 have parts 36 and 37, respectively, with surfaces that bear against the surfaces 29 and 30.

It has been discovered through extensive tests and trial and error that the function of the resilient inserts 34 and 35 is more effective if they are affixed with an adhesive in the apertures, like 31, leaving the parts 36 and 37 as free as possible but bearing against the two surfaces 29 and 30 for transmitting torque to the pulley 13 from the drive shaft 12. This will be understood more clearly when the operation of the pulley is described.

With the pulley 13 assembled in this manner on the drive shaft 12 of the synchronous a.c. motor 11, the drive pin 22 can be moved in one direction against the resilient inserts 34 and 35 which will leave a space, identified as 38 and 39 in FIG. 1. These two spaces 38 and 39 will be described in connection with the operation of the pulley 13.

Figure 3:
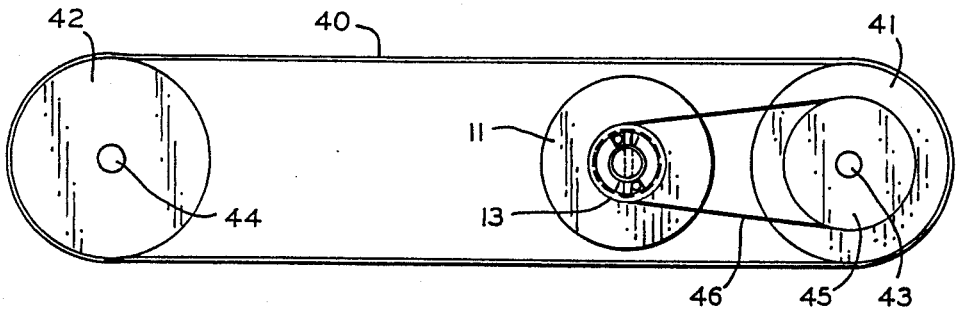
FIG. 3 is a top view of a belt type printer with the drive system of FIG. 1 in place.

Referring now to FIG. 3 of the drawings, the numeral 40 identifies a belt to which are affixed the various type font for use in a printer mechanism, for example as used as a peripheral for a computer (so that the computer can communicate with the operator). Such a belt 40 is moved at high speed and is supported by pulleys 41 and 42 that are rotated on their respective shafts 43 and 44.

An example of the speed of the presently preferred synchronous a.c. motor 11 is 1800 revolutions per minute (R.P.M.). Such a motor can be obtained from, for example, Eastern Air Devices.

The type font belt 40 and the support pulleys 41 and 42 are moved by a pulley 45 supported on the shaft 43. A drive belt 46 connects the pulley 45 to the pulley 13 of the invention so that the synchronous a.c. motor 11 may cause the type belt 40 to move at a desired predetermined speed which, in the preferred arrangement, is reduced from a motor speed of 1800 R.P.M.

Figure 4:
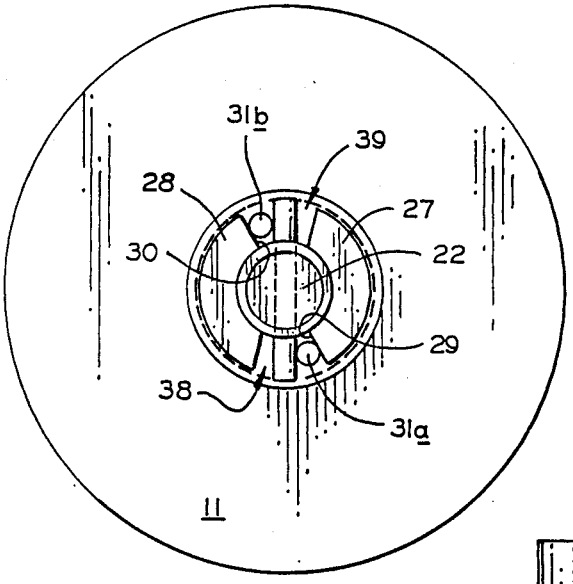
FIG. 4 is an end view of the assembled drive system shown in perspective in FIG. 1.
Figure 5:
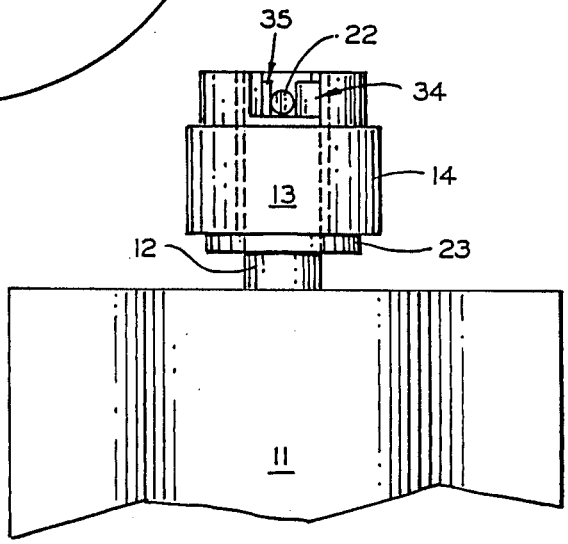
FIG. 5 is a side view of the assembled drive system shown in perspective in FIG. 1.

FIG. 4 and FIG. 5 are views of the assembled unit that is shown in perspective in FIG. 1.

The resilient inserts 34 and 35 are shown in FIG. 5, but they are removed from the end view of FIG. 4 in order to show more clearly the location of the apertures, such as 31 in FIG. 2, identified here in FIG. 4 as 31*a* and 31*b* because only the aperture 31 is visible in the perspective view of FIG. 2. The FIGS. 4 and 5 show the drive pin 22 attached firmly in the shaft 12 of the motor 11, but the pulley 13 is free to pivot angularly on the shaft 12 by the spaces 38 and 39, which permit movement of about 15 degrees.

The bushing 18, being formed of sintered bronze that is impregnated with a lubricant, eliminates corrosion and undue wear concerns. The direction of rotation, as viewed in FIG. 4, is counterclockwise.

OPERATION

When the motor 11 starts to rotate, the pulley 13 is stationary. Movement, therefore, will be through the unrestricted space 38 and 39, until the drive pin 22 contacts the resilient insert 34 and 35. As best seen in FIG. 2, these resilient inserts 34 and 35 are rectangular in configuration, which means that the drive pin 22 will contact, first, a corner of each insert, compressing it as movement of the motor 11 continues, until sufficient force is transmitted through the resilient inserts 34 and 35 to rotate the pulley 13, the drive belt 46, FIG. 3, the pulleys 41 and 42, on their respective shafts 43 and 44, until the type belt 40 is moved.

As the various components in the type belt system come up to speed, which is very quickly, the force required to maintain this movement will be less than at start-up, and the resilient inserts 34 and 35 will push back slightly on the drive pin 22 (The resilient inserts become compressed less). During normal printing operations, the drive pin 22 remains in contact with the resilient inserts, compressing them only slightly, but sufficiently to transmit a smoothly rotating torque to the pulley 13.

When a power line disturbance occurs (the line voltage sometimes drops as much as 30% for a short time), the synchronous a.c. motor 11 will suddenly slow, but will speed up again within, usually, about 10 to 20 milliseconds. With a pulley constructed in accordance with the present invention, as the motor 11 starts to slow, the drive pin 22 gradually disengages from the resilient inserts 34 and 35, losing contact momentarily.

However, the pulley 13, as well as the entire print type belt drive system, FIG. 3, to which it is connected, will continue to rotate during this brief interval because of the inertia and the momentum that is built up in it. When the drive pin 22 loses contact with the resilient inserts 34 and 35 momentarily, it moves back into the spaces 38 and 39, FIG. 4.

After the very brief, momentary interval of about 10 to 20 milliseconds, the synchronous a.c. motor 11 starts to reaccelerate to its normal speed; it will smoothly contact the resilient inserts again, and normal printing (which has continued during this interval) now continues undisturbed. Tests on this arrangement show it to be most effective in eliminating these many small power line disturbances from affecting normal printing operations adversely.

MODIFICATION

Figure 6:
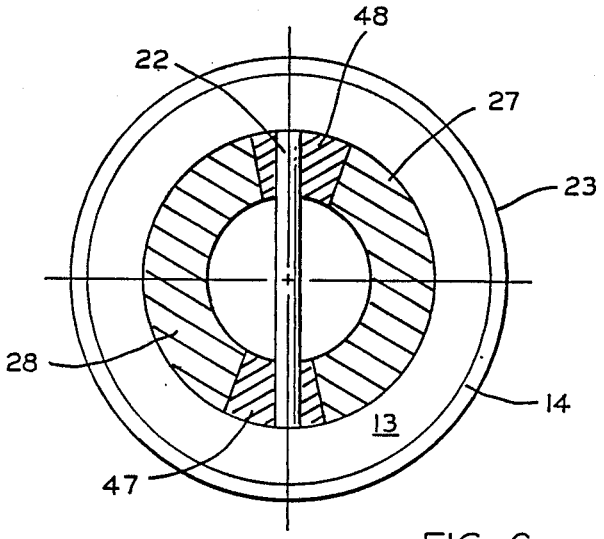
FIG. 6 is an end view, similar to FIG. 4, but showing a modification in accordance with the invention.
Figure 7:
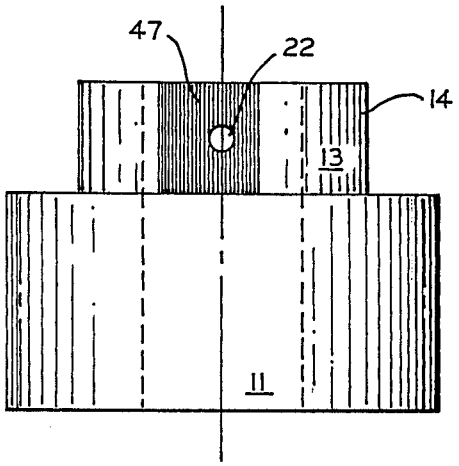
FIG. 7 is a side view of the modification of the invention shown in FIG. 6.

FIGS. 6 and 7 show a modification of the preferred arrangement. The drive pin 22 is embedded completely in the resilient material, here identified by the reference numerals 47 and 48, which substantially fills the spaces 38 and 39, FIG. 4, as well as the space above the apertures 31*a* and 31*b*, also shown in FIG. 4. Another way of viewing the modification of FIGS. 6 and 7 is that the resilient material that is identified as the resilient inserts 34 and 35 in FIGS. 1 and 2 is extended to fill the spaces 38 and 39, also in FIGS. 1 and 2.

By this modification, the synchronous a.c. motor 11 will encounter a resilient material when it slows as well as when it speeds up again. The angular position of the drive pin 22 is asymmetrical, so that the drive direction is less resilient, which still filters out vibrations caused by a 50 or 60 Hertz frequency component in the power line, but the drive pin 22 will encounter less resiliency when it slows.

While the above-described modification is effective for some instances of use, in a high performance belt printer mechanism, the arrangement of FIG. 1 is preferred because it provides a resilient force in the driving direction, while providing for a free movement (or "backlash" ) during a momentary slowdown interval. This structure matches the operational requirements of such a printer mechanism more closely.

It has been discovered that a structure in accordance with the invention provides a resilience in coupling a drive shaft to a driven printer belt, yet permits free play for de-coupling the drive motor from the printer belt during a power line disturbance.

The invention has been shown, described and illustrated in substantial detail with reference to a presently preferred embodiment and with reference to a modification thereof. It will be understood by those skilled in this art that other and further changes and modifications may be made without departing from the spirit and scope of the invention which is set forth in the claims appended hereto.

What is claimed is:

1. In a printer mechanism in which respective type font means is moved by electrical means that is subject to power line disturbances that produce momentary deviations in rotational speed, the combination comprising:

electrical motor means that is subject to power line disturbances, producing a momentary deviation in a predetermined rotational speed, to function as a driver means;

rotatable type font support means, in said printer mechanism to be rotated by said driver means, to function as a driven means;

pulley means connecting said driven means to said driver means;

the improvement comprising:

said driver means having means projecting therefrom to turn said pulley means;

means to de-couple said means projecting from said driver means from said pulley means responsive to said momentary deviation in rotational speed and to re-couple therewith as said driver means returns to said predetermined rotational speed; and resilient means located between said means projecting from said driver means and said pulley means to apply a drive force gradually to said pulley means as said driver means returns to said predetermined rotational speed;

2. In a printer mechanism as defined inc laim 1 wherein said drive shaft has a hole therethrough to receive a drive pin to function as a torque transmitting means.

3. In a printer mechanism as defined in claim 1 wherein said pulley means includes means to define a channel transversely at one side thereof, said resilient means being located within said channel, and said means projecting from said drive shaft of said driver means extends within said channel to transmit a rotatable torque to said pulley means through said resilient means.

4. In a printer mechanism as defined in claim 1 wherein said resilient means has a Durometer value in the range of 75 to 85 Shore A.

5. In a printer mechanism as defined in claim 1 wherein said resilient means are in the form of a plurality of rubber inserts affixed to one side of said pulley means to be acted against by said means projecting from said driver means to vary the force to turn said pulley means.

6. In a printer mechanism as defined in claim 1 wherein said means projecting from said drive shaft of said driver means is in the form of a drive pin to project against said resilient means.

7. In a printer mechanism as defined in claim 6 including means on said pulley means to define a channel; said resilient means being located within said channel; and said drive pin having an end projecting into said channel to apply said drive force to said pulley means through said resilient means.

8. In a printer mechanism as defined in claim 7 wherein said resilient means located within said channel fills said channel surrounding said end of said drive pin.

9. In a printer mechanism as defined in claim 6 wherein said resilient means has a Durometer value in the order of 75 to 85 Shore A.

10. In a printer mechanism as defined in claim 1 wherein said electrical motor means is a synchronous alternating current type.

11. A pulley to rotate a driven element at a predetermined speed by an electrical motor driver element, said pulley having in combination:

a peripheral surface for receiving a predetermined drive belt, two sides, and an axial opening to receive a drive shaft of said electrical motor element;

the improvement comprising:

one of said sides having means to define a space extending transverse of said axial opening;

said space being defined by surfaces extending generally in a plane that includes the axis of said drive shaft;

resilient means within said space and contiguous with at least one of said surfaces;

means affixed to said drive shaft and projecting into said space to apply a rotatable force through said resilient means to develop a predetermined rotational speed; and said space being sufficiently wide to permit said projecting means to retreat from said surface;

whereby said electrical motor driver element is de-coupled from said driven element when said electrical motor element is rotated momentarily at a slower speed.

12. A pulley as defined in claim 11 including means to provide lubrication to said axial opening, so that the drag on said pulley rotating at said predetermined rotational speed is reduced to a minimum as said electrical motor element slows momentarily.

* * * * *